United States Patent [19]

Yamaguchi

[11] Patent Number: 4,497,187

[45] Date of Patent: Feb. 5, 1985

[54] METHOD OF MANUFACTURING A BURNING WICK

[75] Inventor: Yozo Yamaguchi, Nigata, Japan

[73] Assignee: Isaburo Yamaguchi, Nigata, Japan

[21] Appl. No.: 446,581

[22] Filed: Dec. 3, 1982

Related U.S. Application Data

[63] Continuation-in-part of Ser. No. 197,343, Oct. 15, 1980, abandoned.

[51] Int. Cl.[3] ..... D04B 23/02

[52] U.S. Cl. ..... 66/87; 66/202; 66/196

[58] Field of Search ..... 66/87, 196, 83, 170, 66/169, 193, 192, 202

[56] References Cited

U.S. PATENT DOCUMENTS

| | | | |
|---|---|---|---|
| 459,866 | 9/1891 | Clewley | 66/170 |
| 606,719 | 7/1898 | Hill | 66/170 |
| 3,656,323 | 4/1972 | Brown | 66/177 |
| 3,656,324 | 4/1972 | Jackson | 66/177 |
| 3,899,900 | 8/1975 | Jackson | 66/87 |

FOREIGN PATENT DOCUMENTS

| | | | |
|---|---|---|---|
| 1143424 | 10/1957 | France | 66/195 |

*Primary Examiner*—Ronald Feldbaum
*Attorney, Agent, or Firm*—Young & Thompson

[57] ABSTRACT

A burning wick for hydrocarbons and the like is manufactured by continuously forming two wick bodies by two juxtaposed raschel knitting machines, and then fastening the two bodies together transversely along spaced lines, by wrap yarns or other linking yarns. The composite strip thus formed is then cut off along those transverse junction lines, to provide a plurality of separate cylindrical sleeves, each of which serves as a wick. The individual knit wick bodies can have various weaves across their transverse width, such as a burning portion at one edge, an intermediate suction portion for drawing up the fuel, and a bending or stretching portion between the edges of the body and characterized by a reduced number of weft yarns. In this way a cylindrical wick is produced which has various characteristics along its axial length.

1 Claim, 8 Drawing Figures

METHOD OF MANUFACTURING A BURNING WICK

This application is a continuation-in-part of copending application Ser. No. 197,343, filed Oct. 15, 1980 now abandoned.

The present invention relates to the production of burning wicks, such as those used in petroleum-burning apparatus, more particularly to the production of cylindrical wicks from a knitted wick material which originally has the shape of a continuously-produced band.

Various structures of wick are known in the art. Cylindrical wicks are known, which are produced by cutting off lengths of wick material from a continuously knitted band, forming the cut-off portion to a hollow cylindrical shape, and sewing together the confronting edges of the band along a line that extends parallel to the axis of the cylindrical wick thus formed.

Such wick material in the shape of a continuous band is manufactured automatically and efficiently by known raschel knitting machines. However, the operation of cutting the wick material to its desired length, bending it to cylindrical shape, and sewing together the confronting end edges of the cut-off material to produce a cylindrical wick, requires a number of laborious hand operations, with resultant low quantity of production per unit time, and high production costs.

It is accordingly an object of the present invention to overcome these drawbacks of the prior art, by providing a method for producing cylindrical wicks with greatly reduced labor as compared to known methods.

According to the method provided by the present invention, two conventional raschel machines are arranged in confronting relationship, thereby to produce between them continuously two wick bands by knitting, with continuous warp yarns that may vary in character and arrangement from edge to edge of the band thereby to impart different properties to different portions of the wick in a direction parallel to the axis of the completed cylindrical wick. Thus, the bands may be woven according to known technology, so as to have a burning part of glass fiber yarn at one edge, a sucking part of cotton yarn next, and a bending and stretching part, or to have other suitable structure that varies from edge to edge of the continuously produced band, all according to known technology in this art.

The two bands of knit wick material, emerging from the double raschel machines at the same linear velocity, are then secured together along transverse lines at regularly spaced intervals by chain-knitting. The lines of juncture between the two bands are each comprised by a plurality of the warp yarns of the band, or separate linking yarns, the edges of the bands being in registry with each other so that the bands exactly overlie and the end edges of the individual compartments thus formed between the adjacent lines of transverse connection of the bands will be substantially continuous.

The individual transversely extending sleeves or cylinders thus formed, are then cut apart along those lines of transverse juncture, with at least one line of interconnected warps or link yarns on each side of the cut, thereby to produce a series of cut-apart individual cylindrical sleeves each of which has two diametrically opposed seams extending parallel to the axis of the cylinder.

Other objects, features and advantages of the present invention will become apparent from a consideration of the following description, taken in connection with the accompanying drawing, in which.

Figure 1:
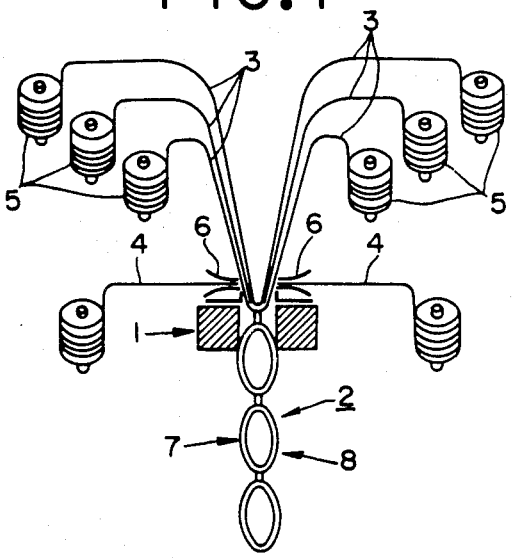
FIG. 1 is a schematic view of apparatus for practicing the present invention.

Referring now to the drawings in greater detail, there is shown generally at 1 a double raschel knitting machine the individual machines of which are quite conventional and are arranged in confronting relationship. Each machine produces a band 2 of knitted wick material constituted by weft 3 and warps 4, the warp yarns being fed from bobbins 5 and comprising a plurality of twisted yarns, and the warps 4 being fed through guide conduits 6 which horizontally reciprocate in a plane perpendicular to the plane of the drawing, in the usual manner for raschel machines.

Figure 2:
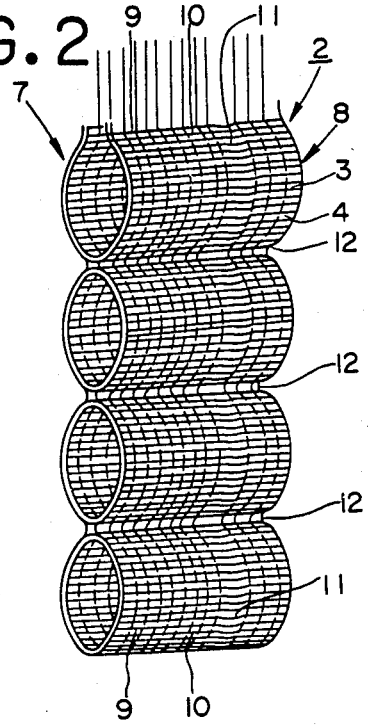
FIG. 2 is an enlarged perspective view of a series of wicks produced according to the present invention, before they are cut apart.

By so choosing the materials on the bobbins 5, and/or the placement of the warp guides, the knitted bands 2 can have structures which vary in nature from edge to edge thereof, as indicated diagrammatically in FIG. 2. As can there be seen, the bands 2 have been interconnected along spaced transverse lines by securing together the warp threads or by providing separate link threads, thereby to produce a plurality of cylindrical interconnected pockets one side 7 of each of which is provided by one of the bands 2 and the other side 8 of each of which is provided by the other band 2. The bands 2 are knitted as explained above, to provide a burning part 9 of glass fibers, a suction part 10 of cotton fibers and a bending and stretching part 11, in succession across the band reading from left to right in FIG. 2 (or top to bottom in FIG. 3). As the two bands 2 are in edgewise registry with each other, the various areas 9, 10 and 11 thus provided will each extend continuously and regularly as an annulus about each of the interconnected wicks.

The individual interconnected wicks are then cut off along the lines 12, with, as explained above, at least one line of interconnection in the weft direction of each side of each cut, whereby both sides of each separate wick thus produced are knitted together, there being accordingly a seam on each side of each wick, the two seams being parallel to each other and to the axis of the cylindrical wick thus produced.

Figure 5:
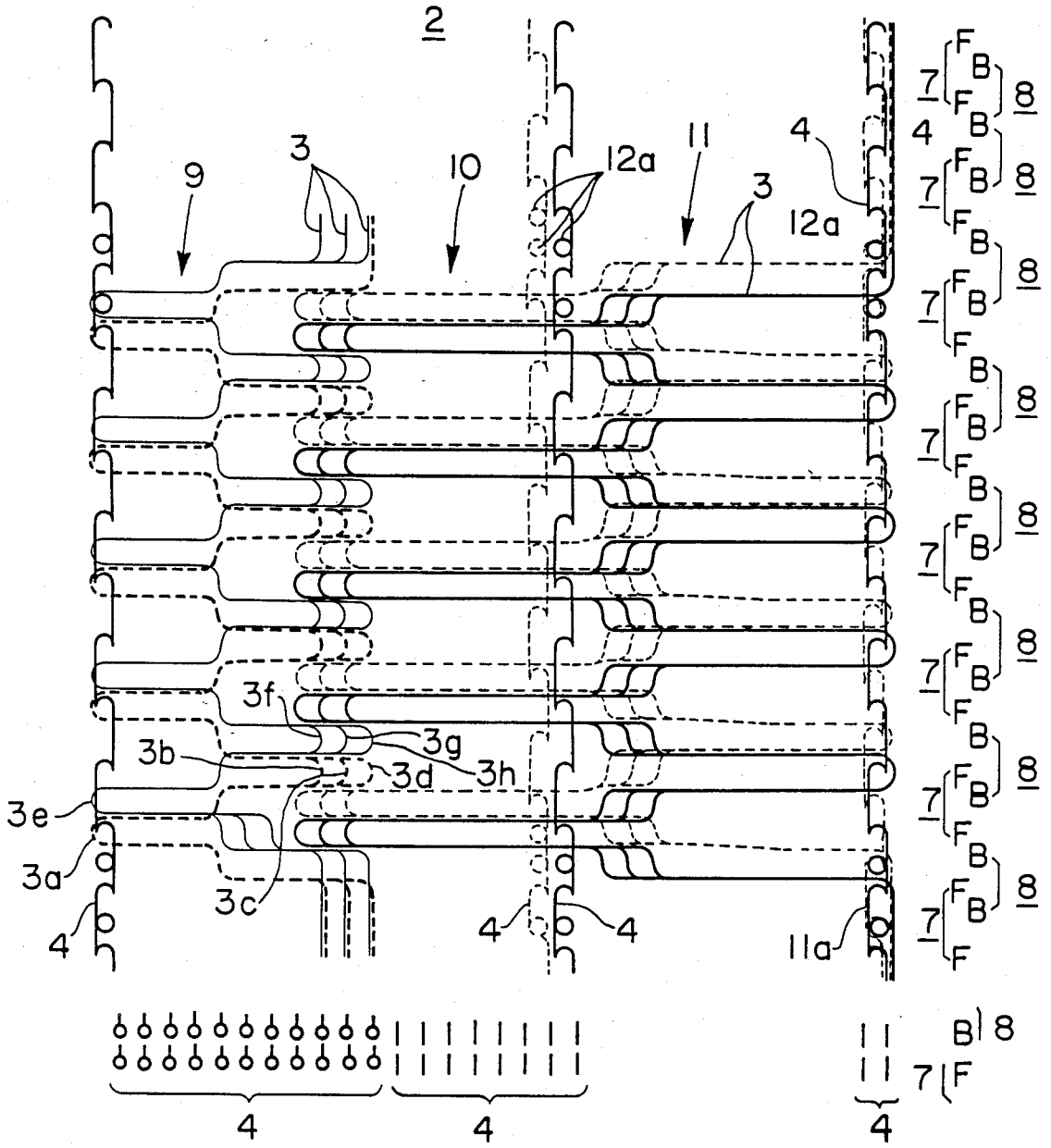
FIG. 5 is a view showing diagrammatically the structure of the burning wick.
Figure 6:
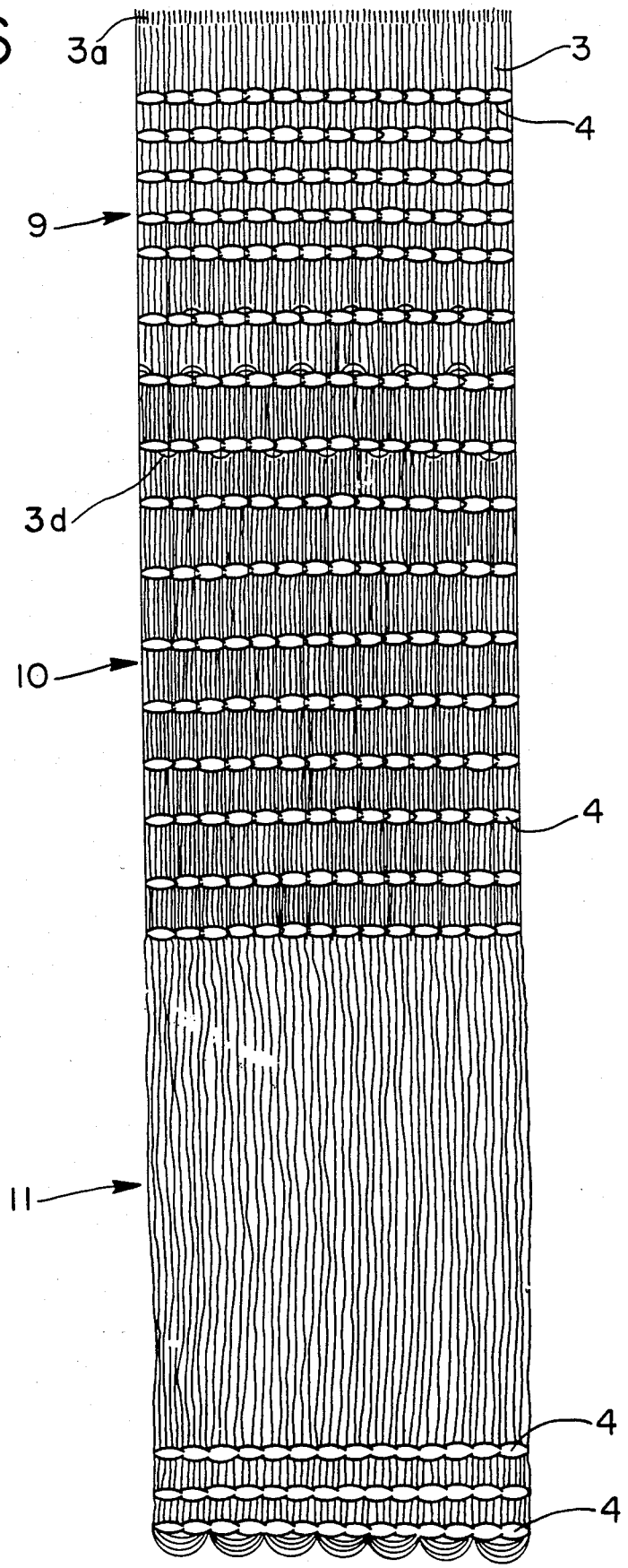
FIG. 6 is an enlarged front view of the burning wick.

As seen in FIG. 5, the wefts 3 and the warps 4 thus comprise the wick body 7 (corresponding to front side F shown in full lines), and 8 (corresponding to back side B shown in dashed lines) by lateral oscillation of the needle, sinker and pipe guide. As will be understood from FIG. 5, in this embodiment, the yarns 3 of the portion corresponding to the part 9 consist of six bundles of glass fiber yarns, disposed three bundles at the front side F and three bundles at the back side B, as also in FIG. 2. The yarns 3 of the portions corresponding to the sucking part 10 and the bending and stretching part 11 consist of six bundles of cotton yarns, disposed three bundles at the front side F and three bundles at the back side B, as also in FIG. 2.

The wefts 3 of glass fiber yarns of the portion corresponding to the burning part 9 consist of 22 bundles which are arranged 11 bundles at the front side F and 11 bundles at the back side B. Furthermore, the wefts 3 of cotton yarns of the portion corresponding to the sucking part 10 consist of 16 bundles which are arranged eight bundles at the front side F and eight bundles at the back side B. The feeding of the wefts 3 to the portion of the bending part 11 is stopped and four bundles of the wefts of cotton yarn are used to form an end 11*a* of the bending and stretching part 11 by two bundles at front side F and two bundles at back side B.

The above wefts 3 are knitted in loop shape to bundle the warps 3. The warps 3 corresponding to the burning part 9 are turned back in the horizontal direction whereby the front side F and back side B are formed in a generally laterally convex shape in FIG. 5. Turning back portions 3*b*, 3*c* and 3*d* of the right side following the turning back of portion 3*a* of the left side are accompanied by stepwise shifting of the wefts 3. Turning back portions 3*f*, 3*g* and 3*h* of the right side following the turning back of portion 3*e* of the wefts 3 at the back side are accompanied by stepwise shifting of the three wefts 3. By turning back the wefts 3 at the front side F and the back side B, gaps are formed at the inner turning back portion.

Figure 7:
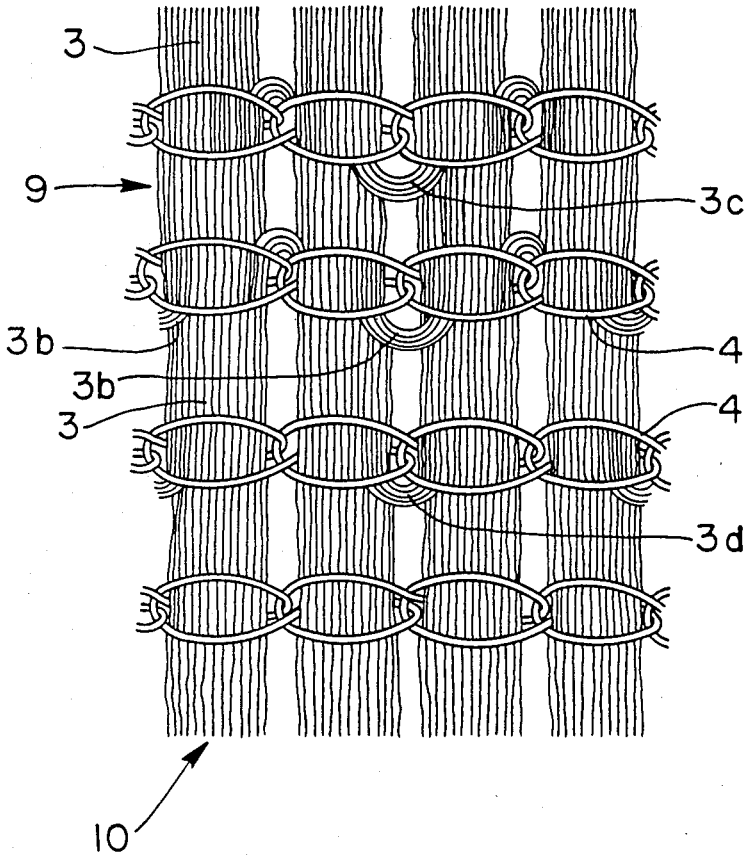
FIG. 7 is a detailed view of the structure shown in FIG. 4.
Figure 8:
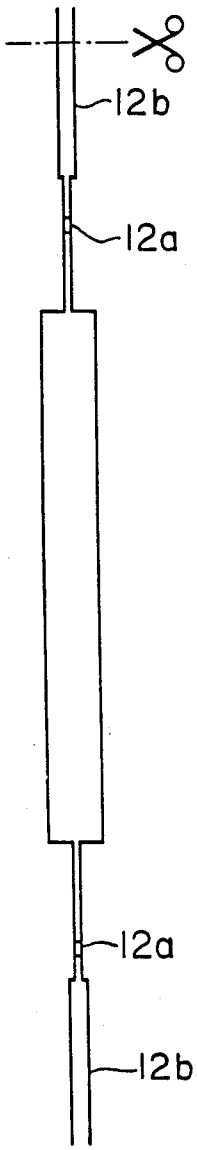
FIG. 8 is a side view of the structure shown in FIG. 5.

The wefts 3 constituting the bending and stretching part 11 and the sucking part 10 are laterally oscillated to enter and to mesh in comb-teeth fashion with the extreme turning back portions 3*i*, 3*k*, 3*l* of the front side F of the sucking part 10, into the gaps of the front side and extreme turning back portions 3*m*, 3*n*, 3*o* of the back side B, and into the gaps of the latter (see FIGS. 5 and 7). The warps 4, together with the lateral oscillation of the warps 3, are fed to knit the burning part 9 and the sucking part 10, and the extreme end 11*a* of the bending and stretching part 11, as shown by the symbols " : glass fiber yarn, |: cotton yarn" on the lower end of the structure shown in FIG. 5. In this manner, blocks of wick body 2 having a bag shape are knitted successively through the link portions 12. In this case, the link portions 12 are bundled by chain knitting 12*a*, as shown in FIGS. 5 and 8, at end edges of the block 7 of the wick body of the front side and the block 8 of the wick body by the wefts 3. Cutting portions 12*b* are formed by straightening the wefts 3 following the chain knitting and furthermore, the chain knitting is performed next to the cutting portions 12*b* whereby the next block of wick body 2 may be knitted as mentioned above.

In the manner recited above, when the blocks of wick body 7, 8 are knitted and connected at both longitudinal ends, the superposed blocks of wick body 7, 8 lie in a row at the link portions 12, and by cutting these link portions 12 with suitable means, a cylindrical burning wick is obtained.

Figure 3:
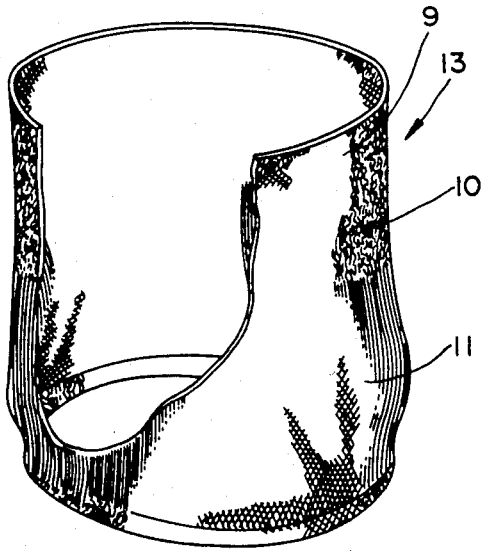
FIG. 3 is a still further enlarged partially broken away perspective view of an individual wick produced according to the invention.
Figure 4:
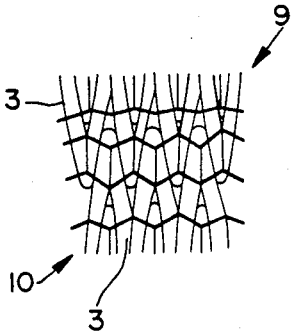
FIG. 4 is a still further enlarged schematic view of the yarns in the junction between the burning part and the sucking part of a wick produced according to the present invention.

That is, as shown in FIG. 3, in a cylindrical burning wick 13, the burning part 9 of glass fiber yarns is knitted at its upper portion. The sucking part 10 of cotton yarns is knitted following the burning part 9 and then the bending and stretching part 11 of cotton yarns follows the burning part 9. The burning wick 13 of such a structure, as understood from the previous description, is formed by connecting and knitting the blocks of wick body in band shape to each other at their connecting edges.

As described above in detail, the invention is adapted to superpose the blocks of wick body in band shape which are knitted and fed at a desired distance from the link portions and which are knitted by the warps and wefts which are of glass fiber yarns in the burning part and other material such as cotton yarns in the parts other than the burning part, to connect both ends of the blocks of wick body each by the wefts, and to cut off the adjacent blocks of wick body along cutting portions in which the wefts are not chain knitted. Accordingly, the method of the invention has the useful result that a cylindrical burning wick can be manufactured successively and automatically by knitting the blocks of wick body from yarns, and that because the method necessitates no hand working, such as machining as in the prior method, the manufacturing cycle of the wick can be largely automated and therefore the improvement of work efficiency, labor saving and reduction of manufacturing costs are possible. Also, since the blocks of wick body are cut from the portions not chain knitting the wefts, the latter does not fray on cutting. Furthermore, because the warps of the burning part and the sucking part are knitted and connected by the wefts so that the turning portions at their extreme edges enter into each other therein, the warps can be connected integrally with each other, irrespective of their different materials, and oil is sucked up smoothly since the contact area is larger.

From a consideration of the foregoing disclosure, therefore, it will be evident that the initially recited object of the present invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A method of knitting tubular burning wicks by warp knitting two set of warp yarns into a continuous two ply web of back to back, superposed single knit fabrics formed into open ended tubular wicks by a plurality of narrow seam areas in which the warp yarns of one fabric are cross interlooped with the warp yarns of the other fabric to form a single ply in the seam area, comprising knitting a warp knit fabric having three contiguous sections;

knitting the first section of glass yarns forming at least eight wales of warp stitches and inlaying glass yarns in said wales;

knitting the second contiguous section of at least seven wales of cotton yarn and inlaying cotton weft yarns in the last-named wales;

knitting the third contiguous section with said inlaid yarns of said second section and traversing over a substantial number of needles wherein no warp stitches are formed until an edge portion; and knitting in said edge portion at least two warp knit cotton yarns to form terminal wales at the edge of the web.

* * * * *